US008672728B2

(12) United States Patent
Chan

(10) Patent No.: US 8,672,728 B2
(45) Date of Patent: Mar. 18, 2014

(54) FEMALE BREAST PAD

(76) Inventor: Jennifer Wu Chan, Scarsdale, NY (US)

( * ) Notice: Subject to any disclaimer, the term of this patent is extended or adjusted under 35 U.S.C. 154(b) by 69 days.

(21) Appl. No.: 13/470,612

(22) Filed: May 14, 2012

(65) Prior Publication Data

US 2013/0303051 A1 Nov. 14, 2013

Related U.S. Application Data

(63) Continuation-in-part of application No. 29/417,005, filed on Mar. 29, 2012, now abandoned.

(51) Int. Cl.
*A41C 3/00* (2006.01)

(52) U.S. Cl.
USPC ..... 450/54; 450/57

(58) Field of Classification Search
USPC ..... 450/54–58, 37, 38, 39; 2/267, 268; 623/7, 8
See application file for complete search history.

(56) References Cited

U.S. PATENT DOCUMENTS

| | | | | |
|---|---|---|---|---|
| 2,323,143 | A | 6/1943 | Loeffel | |
| 2,435,860 | A | 2/1948 | Wilkenfeld et al. | |
| 2,664,571 | A | 1/1954 | Kempel | |
| 2,748,771 | A | 6/1956 | Richards | |
| 2,793,369 | A | 6/1957 | Panighini | |
| 2,834,352 | A * | 5/1958 | Ullian | 450/57 |
| 2,843,130 | A | 7/1958 | Block et al. | |
| 3,067,431 | A | 12/1962 | Kausch | |
| 3,384,091 | A * | 5/1968 | Block | 450/54 |
| 3,620,222 | A | 11/1971 | Block | |
| D234,445 | S | 3/1975 | Greenblatt | |
| 5,149,336 | A | 9/1992 | Clarke et al. | |
| D347,278 | S | 5/1994 | Higa | |
| 5,603,653 | A | 2/1997 | Hartman | |
| 5,823,852 | A | 10/1998 | Chu | |
| D400,337 | S | 11/1998 | Snyder, Jr. | |
| D462,153 | S | 9/2002 | Nadsady et al. | |
| 6,814,647 | B1 * | 11/2004 | Huang | 450/39 |
| 6,824,444 | B2 * | 11/2004 | Huang | 450/57 |
| 7,244,167 | B2 | 7/2007 | Falla | |
| D571,529 | S | 6/2008 | Cook | |
| D581,129 | S | 11/2008 | Marshall | |
| 7,922,560 | B2 * | 4/2011 | Avalos-Dessner et al. | 450/39 |
| D655,476 | S | 3/2012 | Naughton et al. | |
| D661,056 | S | 6/2012 | Cho | |
| 8,216,021 | B1 | 7/2012 | MacKinnon | |
| 8,221,189 | B2 * | 7/2012 | Chen et al. | 450/81 |
| 8,262,433 | B2 * | 9/2012 | Castellano | 450/39 |
| 2005/0005345 | A1 | 1/2005 | Chen | |
| 2005/0090182 | A1 | 4/2005 | Huang | |
| 2010/0029176 | A1 * | 2/2010 | Chen et al. | 450/38 |
| 2010/0105285 | A1 | 4/2010 | Shao | |
| 2010/0180358 | A1 | 7/2010 | Drummond et al. | |
| 2011/0104984 | A1 | 5/2011 | Thaves | |

(Continued)

*Primary Examiner* — Gloria Hale
(74) *Attorney, Agent, or Firm* — Karl F. Milde, Jr.; Eckert Seamans Cherin & Mellott, LLC

(57) ABSTRACT

A female breast pad comprises a rounded, concave cup portion configured to cover a female breast and a side portion, contiguous therewith, that is configured to extend laterally to one side away from the cup portion. The pad includes an elevated protrusion on its inner surface, located in an area between the cup portion and the outer edge of the side portion which is farthest from the cup portion. This protrusion as well as the lateral extension of the side portion inhibit the pad from sliding toward the center of the wearer during use.

20 Claims, 5 Drawing Sheets

(56) References Cited

U.S. PATENT DOCUMENTS

2011/0217903 A1 9/2011 Harlow
2011/0223831 A1 9/2011 Sobah-Wilhelm et al.
2012/0083863 A1 4/2012 Gillespie
2012/0171930 A1 7/2012 Kaufman

* cited by examiner

FEMALE BREAST PAD

CROSS-REFERENCE TO RELATED. APPLICATION

This application is a continuation-in-part, and claims priority from, the U.S. Design patent application Ser. No. 29/417,005 filed Mar. 29, 2012, and entitled "Female Breast Pads", now abandoned.

BACKGROUND OF THE INVENTION

The present invention relates to a female breast pad, or pair of pads, which are worn to cover breasts for modesty and to provide shape and contour when exercising or playing sports with tight-fitting clothes.

When exercising, playing sports, or otherwise appearing in public wearing sports clothing, women often wear tight fitting but comfortable lightweight shirts, tank tops or leotards. A brassiere can be worn beneath this clothing but, because the clothing is itself somewhat supportive, it is not always necessary to do so. Furthermore, a brassiere is sometimes uncomfortable when engaging in strenuous exercise and, especially when a tank top is worn, the shoulder straps of the brassiere are often visible and unsightly.

In cases where the lightweight sports clothing provides the necessary breast support and a brassiere is not worn, the clothing is usually relatively thin and thus reveals the breast shape which includes the nipples. For reasons of modesty, extra material is sometimes sewn inside the clothing to cover the breasts, but such measures inhibit the wicking of perspiration and result in increased discomfort.

Finally, a sports bra or even tight-fitting clothing tends to press tightly against the chest, creating an unnatural "flattened" look when exercising.

SUMMARY OF THE INVENTION

It is a principal object of the present invention to provide a female breast pad which serves to provide support and concealment when wearing sports clothing.

It is a further object of the present invention to provide a female breast pad that obviates the need to wear a sports bra when exercising.

It is a still further object of the present invention to provide a pair of pads which provide support to the female breasts and maintain a natural-looking shape and contour.

It is yet a further object of the present invention to provide a pair of female breast pads that can be worn beneath sports clothing without straps or adhesives and yet remain in position during exercise.

These objects, as well as other objects which will become apparent from the discussion that follows, are achieved, according to the present invention, by providing a breast pad having inner and outer surfaces with a surrounding outer edge and which comprises a rounded, concave cup portion configured to cover a female breast and a side portion, contiguous therewith, that is configured to extend laterally to one side away from the cup portion. The pad includes an elevated protrusion on its inner surface, located in an area between the cup portion and the outer edge of the side portion which is farthest from the cup portion. This protrusion as well as the lateral extension of the side portion inhibit the pad from sliding toward the center of the wearer during use.

The side portion of the pad is preferably configured to extend toward the armpit of the wearer, and most preferably all the way to the armpit of the wearer.

Whereas the use of tight-filling clothing when exercising tends to press the breasts together, use of a pair of breast pads according to the invention retains the breasts in their proper position and protects against this flattening. It has been found that the provision of breast pads with the aforementioned side portion with a shaped inner surface causes the pads to remain in place on either side without a tendency to press toward the center. For maximum comfort while maintaining effectiveness, the pad protrusion on the inner surface is preferably in the range of ⅛ inch to ½ inch in height and most preferably approximately ¼ inch in height.

The protrusion is configured in plan view to substantially match the contour of the outer edge of said side portion which is farthest from said cup portion. The protrusion is thus preferably moon-shaped or V-shaped in plan view.

For comfort, the protrusion is rounded, for example semi-circular, in cross-sectional view.

To further inhibit movement of the breast pad when it is in place, either the outer or inner surface thereof, or both, may be made rough to the touch. This measure inhibits slippage between the pad and either the garment or the skin of the wearer, respectively, with which it is in contact.

Preferably, the pad is made porous to air and moisture, permit evaporation and wicking of moisture. This can be Implemented, for example, by using a naturally porous material, such as a plastic sponge material, or by creating a large number of small holes that extend through the pad, from inner surface to outer surface. The sponge material may be a polyamide foam, for example, and may be covered with a polyester mesh fabric lining.

To aid in the removal of moisture, the pad may be impregnated with a moisture-absorbing agent. Alternatively or in addition, the pad may be impregnated with an anti-bacterial agent.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
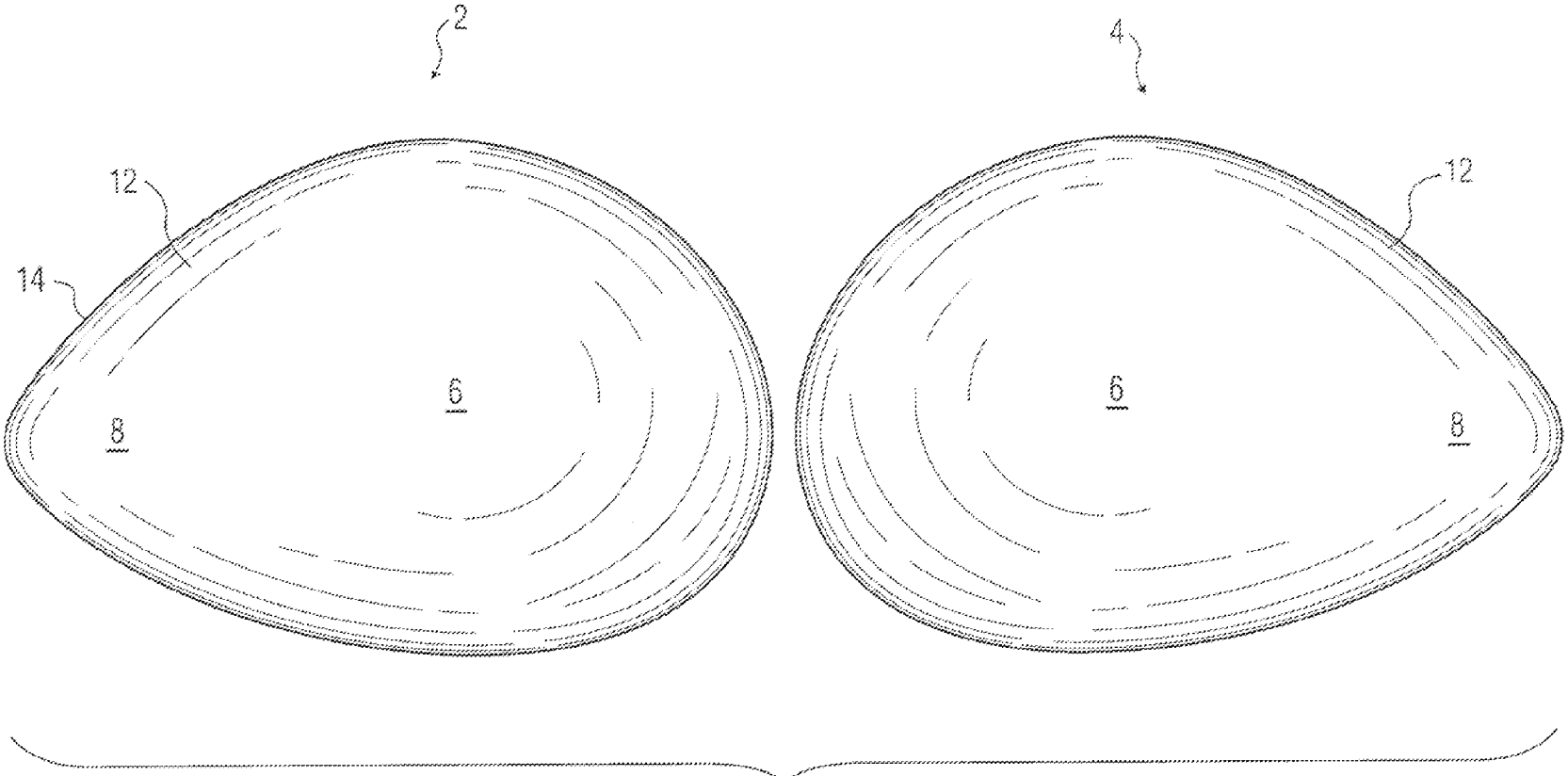
FIG. 1 is a front view of a pair breast pads according to a first preferred embodiment of the present invention.

The preferred embodiments of the present invention will now be described with reference to FIGS. 1-7 of the drawings. Identical elements in the various figures are designated with the same reference numerals.

FIG. 1 shows a pair of breast pads, a "right side pad" 2 and a "left side pad" 4, each having a rounded, concave cup portion 6 configured to cover a female breast and a side portion 8, contiguous therewith, which is configured to extend laterally to one side, away from the cup portion, toward an armpit of a wearer.

Figure 2:
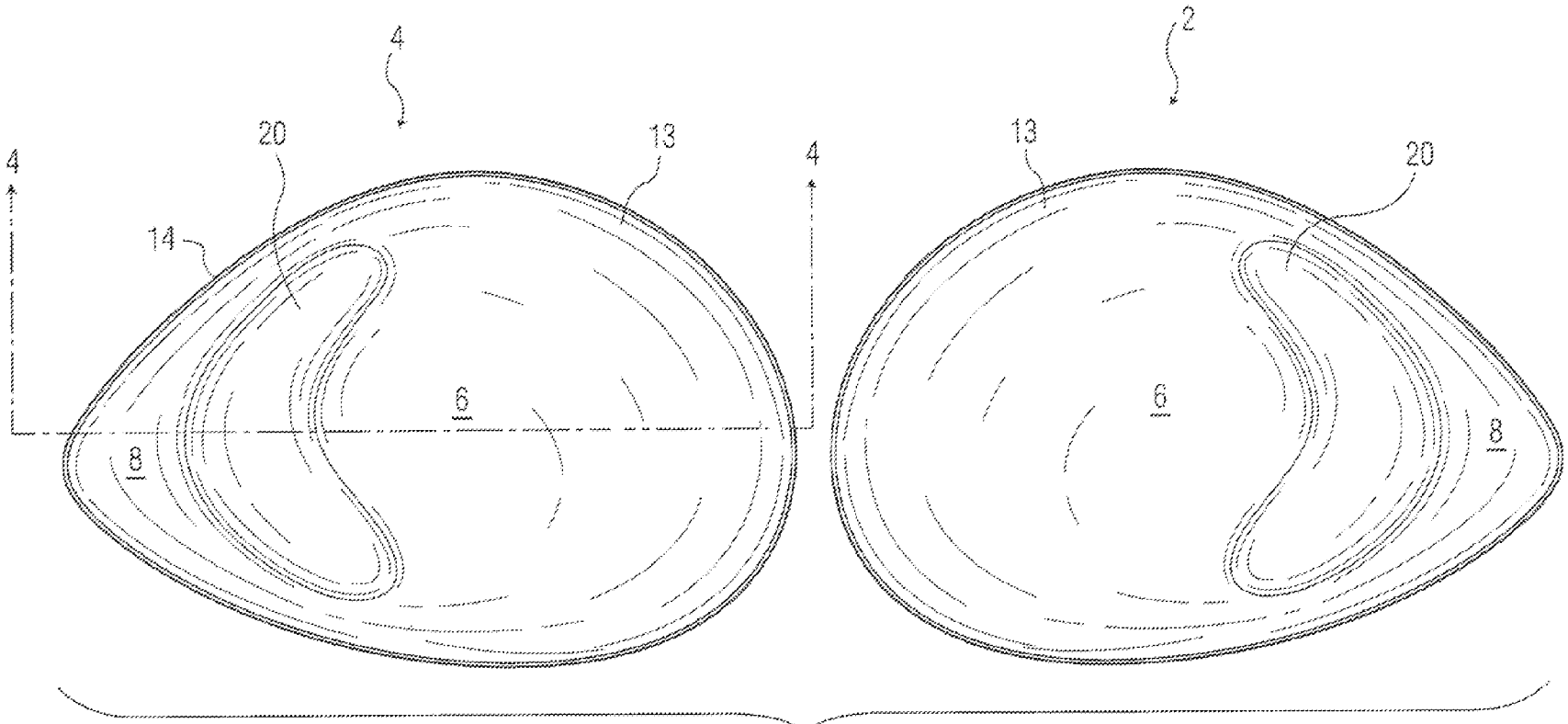
FIG. 2 is a rear view of the breast pads of FIG. 1 showing a moon-shaped protrusion on the inner surfaces thereof.
Figure 3:
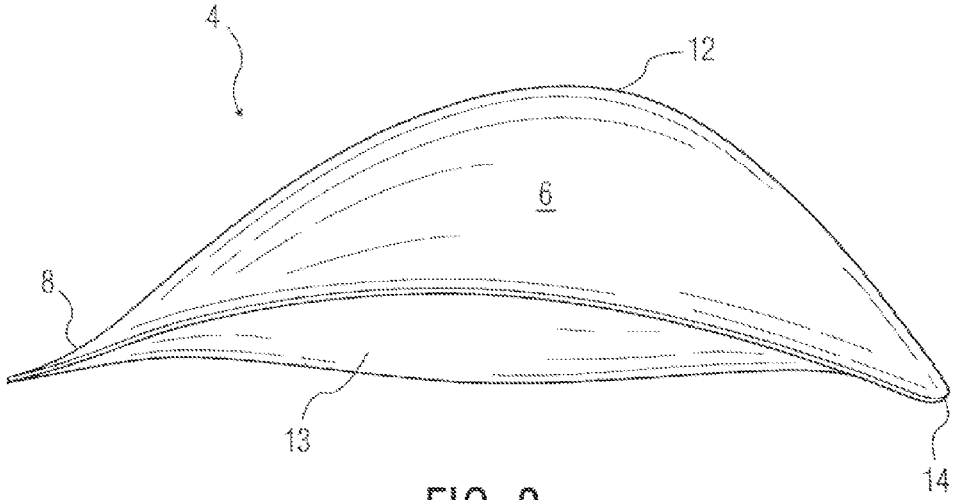
FIG. 3 is a side view of one of the breast pads of FIG. 1 showing a central cup portion and a side portion.

Whereas FIG. 1 shows the breast pads in front view, FIG. 2 shows the same pads in rear view. The outer surface of the pads, which appears in FIG. 1, is designated as 12, whereas the inner surface, appearing in FIG. 2, is designated as 13. The pads are surrounded by an outer edge 14 which delineates an oblong, oval shaped contour.

As shown in FIG. 2, the inner surface 13 is provided with an elevated, moon-shaped protrusion 20 located on the side portion 8, nearly filling an area of each pad between the cup portion 6 and the outer edge 14 of the side portion which is farthest from the cup portion.

The side portion 8 of each pad extends laterally toward the armpit of the wearer and can be configured to extend all the way to the armpit of the wearer.

Figure 4:
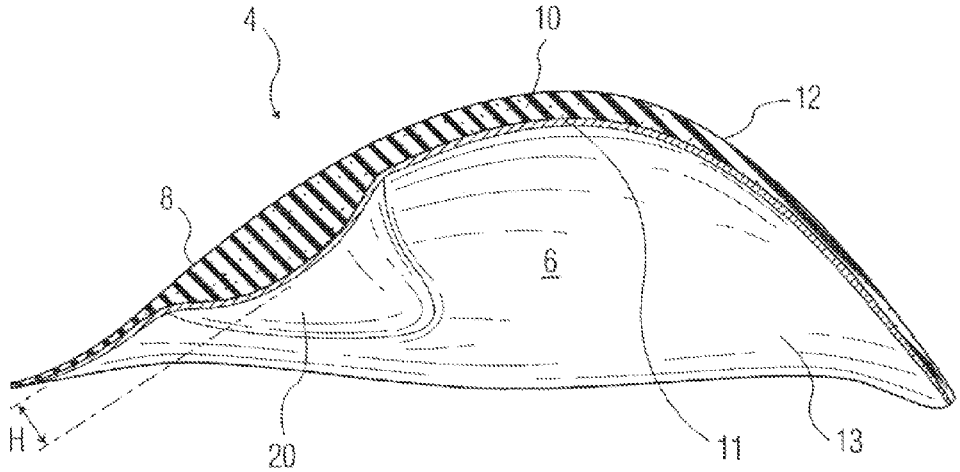
FIG. 4 is a cross-sectional view of the breast pad of FIG. 3.

As shown in a cross-section of the left pad 4 in FIG. 4, the pad protrusion 20 has a height H, above its surrounding inner surface 13. This height H is preferably in the range of ⅛ inch to ½ inch. The height H of the protrusion 20 in FIG. 4, which is shown approximately to scale, is ¼ inch.

For comfort, the protrusion is rounded—for example, semi-circular—as shown in cross-sectional view in FIG. 4.

As is further illustrated in cross-section in FIG. 4, the breast pad is made of a plastic (e.g., polyamide) foam material 10 which is covered on its inner surface 13 with a lining 11 made, for example, of a polyester mesh fabric.

To inhibit movement of the breast pad when it is in place, either one or both of the inner and outer surfaces are preferably made rough to the touch. This measure inhibits slippage between the pad and either the garment or the skin of the wearer, respectively, with which it is in contact.

Preferably, both the sponge material 10 and the lining 11 are made porous to air and moisture to permit wicking and evaporation of moisture. To increase the porosity of the plastic sponge material and the mesh fabric lining, the pad may be provided with a large number of small holes that extend therethrough. To aid in the removal of moisture, the sponge material may be impregnated with a moisture-absorbing agent. Alternatively, or in addition, the sponge material may be impregnated with an anti-bacterial agent.

Figure 5:
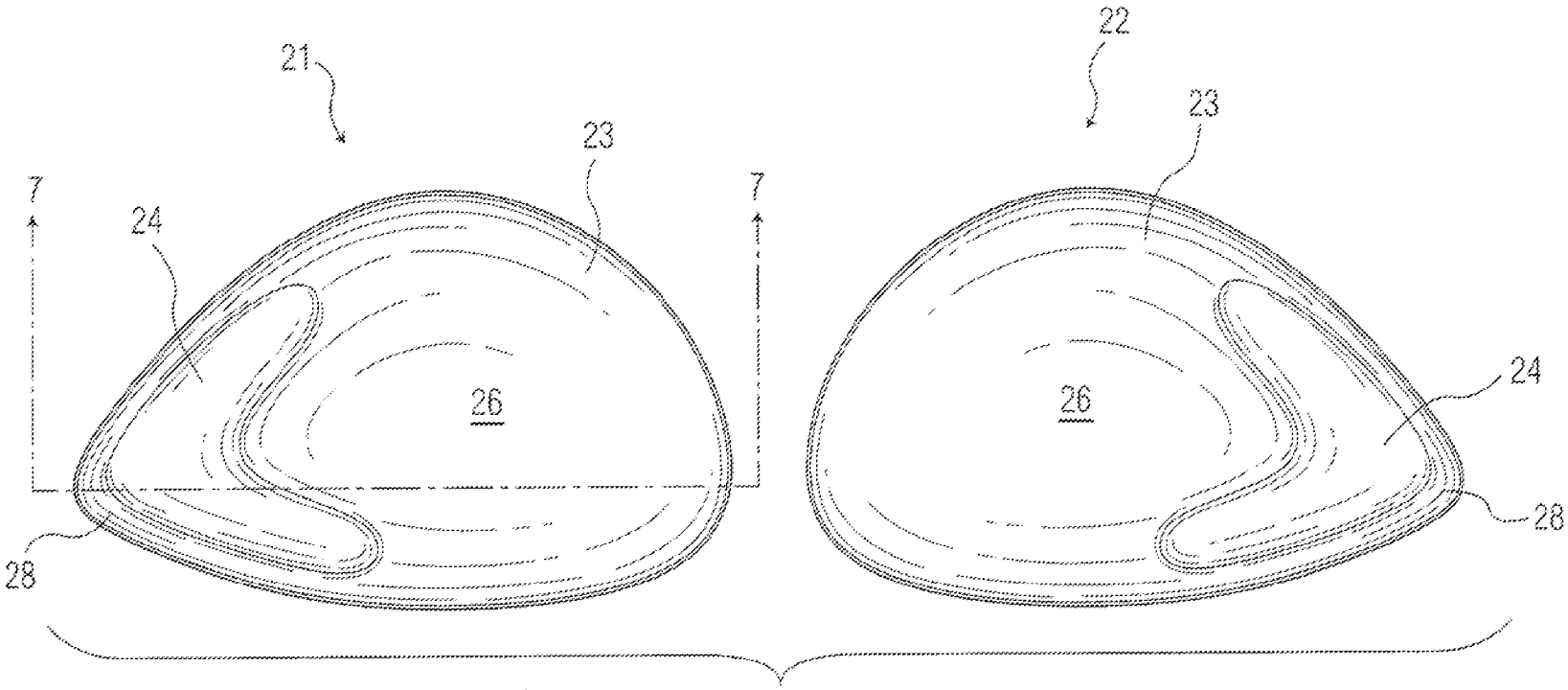
FIG. 5 is a rear view of a pair breast pads according to a second preferred embodiment of the present invention.
Figure 6:
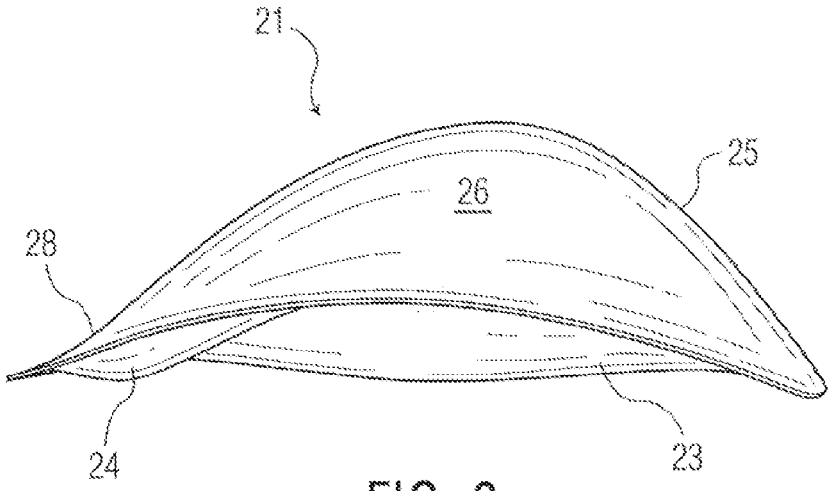
FIG. 6 is a side view of one of the breast pads of FIG. 5 showing a central cup portion and a side portion.
Figure 7:
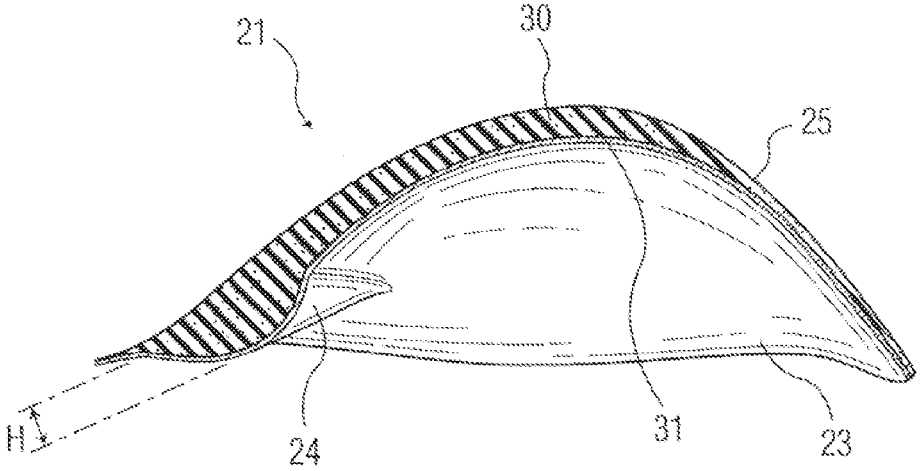
FIG. 7 is a cross-sectional view of the breast pad of FIG. 6.

FIGS. 5-7 illustrate a second preferred embodiment which has a slightly different shape than the first embodiment shown in FIGS. 1-4. FIG. 5, which is comparable to FIG. 2 for the first embodiment, shows the left 21 and right 22 breast pads having an inner surface 23 and a V-shaped protrusion 24. In this embodiment, the side portion 28 extends laterally outward a greater distance from the central cup portion 26 than in the first embodiment. The protrusion 24 closely follows the V-shaped contour of the outer edge of this side portion.

As shown in FIG. 7, the height H of the protrusion 24 above the surface 23 is slightly less than ¼ inch.

As in the case of the first embodiment, the pad is formed of a plastic sponge material 30 which is provided with a mesh fabric lining 31 forming the inner surface 23.

The breast pads according to the invention require no means of attachment when placed beneath tight-fitting sports clothing. The pads are designed to maintain their position, due to the presence of the side portions 8 and 28 and the "bumps" or protrusions on their inner surface.

The pads are extremely comfortable to wear and maintain the shape and contour of the female breast notwithstanding the tendency of the tight fitting clothing to flatten the breast area.

Finally, the pads are machine or hand washable and can be reused multiple times to enhance one's appearance whenever tight-fitting clothes are worn.

There has thus been shown and described a novel female breast pad which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An oval shaped female breast pad adapted to be worn without attachment under sports clothing said pad comprising inner and outer surfaces with a surrounding outer edge defining a center of the pad, said pad having a rounded, concave cup portion configured to cover a female east and a side portion, contiguous therewith, that is configured to extend laterally to one side away from the cup portion, wherein said pad includes an elevated protrusion on said inner surface thereof, located on the side portion in an area both above and below the center and between the cup portion and the outer edge of said side portion that is farthest from the cup portion, thereby to inhibit the pad from sliding sideways during use toward a center of the wearer's chest.

2. The breast pad defined in claim 1, wherein a height of said protrusion from its base on said inner surface to its maximum elevation is in the range of ⅛ inch to ½ inch.

3. The breast pad defined claim 2, wherein a height of said protrusion from its base on said inner surface to its maximum elevation is approximately ¼ inch.

4. The breast pad defined in claim 1, wherein said protrusion is configured plan view of the pad to substantially match a contour of the outer edge of said side portion which is farthest from said cup portion.

5. The breast pad defined in claim 4, wherein said protrusion is moon-shaped in plan view of the pad.

6. The breast pad defined in claim 4, wherein said protrusion is V-shaped in plan view of the pad.

7. The breast pad defined in claim 1, wherein said protrusion is rounded in cross-sectional view of the pad.

8. The breast pad defined in claim 7, wherein said protrusion is semi-circular in cross-sectional view of the pad.

9. The breast pad defined in claim 1, wherein the out r surface is configured to inhibit slippage between the pad and a garment of the wearer which is in contact therewith.

10. The breast pad defined in claim 1, wherein the inner surface is configured to inhibit slippage between the pad and the skin of the wearer which is in contact therewith.

11. The breast pad defined in claim 1, wherein the pad is porous to air and moisture.

12. The breast pad defined in claim 11, wherein the pad is formed of a porous material.

13. The breast pad defined in claim 11, wherein the pad has a plurality of holes extending through it.

14. The breast pad defined in claim 1, wherein the pad is impregnated with a moisture-absorbing agent.

15. The breast pad defined in claim 1, wherein the pad is impregnated with an anti-bacterial agent.

16. The breast pad defined in claim 1, wherein the pad made of a plastic sponge materiel.

17. The breast pads in claim 16, wherein the plastic sponge material is a polyamide foam.

18. The breast pad defined in claim 16, wherein said sponge material is covered with a polyester mesh fabric lining.

19. The breast pad defined in claim 1, wherein said side portion of the pad is configured to extend outward from the cup portion in a direction toward the armpit of the wearer.

20. The breast pad defined in claim 19, wherein said side portion of the pad is configured to extend into the armpit of the wearer.

* * * * *